US011181847B2

(12) United States Patent
Anno et al.

(10) Patent No.: US 11,181,847 B2
(45) Date of Patent: Nov. 23, 2021

(54) CARRIER FOR ELECTROSTATIC IMAGE DEVELOPMENT, ELECTROSTATIC IMAGE DEVELOPER, AND PROCESS CARTRIDGE

(71) Applicant: FUJIFILM Business Innovation Corp., Tokyo (JP)

(72) Inventors: Shintaro Anno, Kanagawa (JP); Takuro Watanabe, Kanagawa (JP); Yasuaki Hashimoto, Kanagawa (JP); Yasuo Kadokura, Kanagawa (JP); Kazutsuna Sasaki, Kanagawa (JP); Jumpei Iwasaki, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/841,670

(22) Filed: Apr. 6, 2020

(65) Prior Publication Data

US 2021/0088924 A1 Mar. 25, 2021

(30) Foreign Application Priority Data

Sep. 24, 2019 (JP) ..... JP2019-173036

(51) Int. Cl.

| | |
|---|---|
| ***G03G 9/00*** | (2006.01) |
| ***G03G 9/107*** | (2006.01) |
| ***G03G 9/113*** | (2006.01) |
| ***G03G 21/18*** | (2006.01) |
| ***G03G 9/083*** | (2006.01) |
| ***G03G 9/087*** | (2006.01) |
| ***G03G 9/08*** | (2006.01) |

(52) U.S. Cl.

CPC ..... *G03G 9/1075* (2013.01); *G03G 9/081* (2013.01); *G03G 9/0819* (2013.01); *G03G 9/0839* (2013.01); *G03G 9/08753* (2013.01); *G03G 9/1131* (2013.01); *G03G 9/1139* (2013.01); *G03G 21/18* (2013.01)

(58) Field of Classification Search

CPC ... G03G 9/1075; G03G 9/1139; G03G 9/1131
USPC ..... 430/111.35
See application file for complete search history.

(56) References Cited

U.S. PATENT DOCUMENTS

| | | | | |
|---|---|---|---|---|
| 9,304,427 | B2 * | 4/2016 | Iwatsuki | G03G 9/1131 |
| 2005/0238980 | A1 * | 10/2005 | Yamashita | G03G 9/107 430/108.1 |
| 2012/0208120 | A1 * | 8/2012 | Ninomiya | G03G 9/0821 430/110.3 |

FOREIGN PATENT DOCUMENTS

| | | |
|---|---|---|
| JP | 2007041549 | 2/2007 |

* cited by examiner

*Primary Examiner* — Mark A Chapman
(74) *Attorney, Agent, or Firm* — JCIPRNET

(57) ABSTRACT

A carrier for electrostatic image development includes: a core material; and a coating resin layer that contains inorganic particles and covers the core material. The content of the inorganic particles is 10% by mass or more and 60% by mass or less based on the total mass of the coating resin layer. The volume average diameter D (μm) of the inorganic particles and the thickness T (μm) of the coating resin layer satisfy the following relational expression (1): $0.007 \leq D/T \leq 0.24$.

12 Claims, 2 Drawing Sheets

CARRIER FOR ELECTROSTATIC IMAGE DEVELOPMENT, ELECTROSTATIC IMAGE DEVELOPER, AND PROCESS CARTRIDGE

CROSS-REFERENCE TO RELATED APPLICATIONS

This application is based on and claims priority under 35 USC 119 from Japanese Patent Application No. 2019-173036 filed Sep. 24, 2019.

BACKGROUND

(i) Technical Field

The present disclosure relates to a carrier for electrostatic image development, to an electrostatic image developer, and to a process cartridge.

(ii) Related Art

Japanese Unexamined Patent Application Publication No. 2007-041549 discloses a two-component developer containing a carrier and a toner. The carrier includes a porous carrier body having surface irregularities and silica adhering to the surface of the carrier body. The porosity of the carrier body is 5 to 25%, and the amount of the silica adhering to the surface of the carrier body is 1 to 10 parts by weight based on 1000 parts by weight of the carrier body.

SUMMARY

When a conventional electrostatic image developer containing "a carrier for electrostatic image development that includes a core material and a coating resin layer containing inorganic particles and covering the core material" is used, density unevenness may occur in images.

Aspects of non-limiting embodiments of the present disclosure relate to an electrostatic image developer that can reduce density unevenness in images as compared with "a carrier for electrostatic image development in which a content of the inorganic particles is 10% by mass or more and 60% by mass or less based on the total mass of the coating resin layer,"

"a carrier for electrostatic image development in which a volume average diameter D (μm) of the inorganic particles and a thickness T (μm) of the coating resin layer do not satisfy a relational expression (1) described later," or "the case where, when a mixture obtained by mixing 100 parts by mass of a carrier separated from an electrostatic image developer containing silica particles as an external additive for a toner and 10 parts by mass of a model toner using a turbula mixer at a temperature of 20° C. for a stirring time of 2 minutes is again separated into the carrier and the model toner using a gauge mesh, the liberation ratio of the silica particles from the surface of the carrier before and after separation of the carrier from the model toner is less than 50%."

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a carrier for electrostatic image development, including:

a core material; and a coating resin layer that contains inorganic particles and covers the core material, wherein the content of the inorganic particles is 10% by mass or more and 60% by mass or less based on a total mass of the coating resin layer, and wherein the volume average diameter D (μm) of the inorganic particles and the thickness T (μm) of the coating resin layer satisfy the following relational expression (1):

$$0.007 \leq D/T \leq 0.24.$$

BRIEF DESCRIPTION OF THE DRAWINGS

Exemplary embodiments of the present disclosure will be described in detail based on the following figures, wherein.

DETAILED DESCRIPTION

Figure 1:
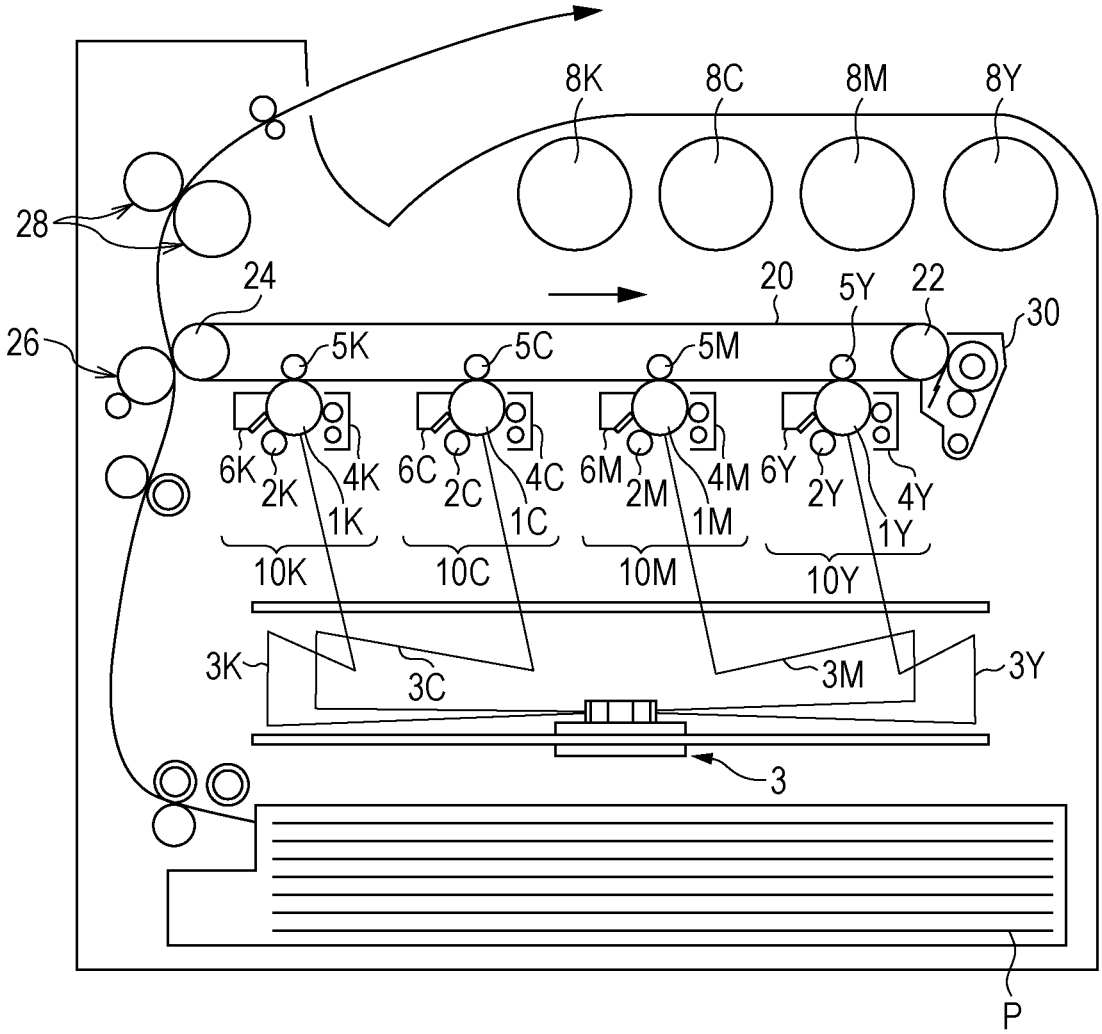
FIG. 1 is a schematic configuration diagram showing an example of an image forming apparatus according to an exemplary embodiment.

Exemplary embodiments will be described below. The description and Examples are illustrative of the exemplary embodiments and are not intended to limit the scope of the exemplary embodiments.

In a set of numerical ranges expressed in a stepwise manner in the present specification, the upper or lower limit in one numerical range may be replaced with the upper or lower limit in another numerical range in the set. Moreover, in a numerical range described in the present specification, the upper or lower limit in the numerical range may be replaced with a value indicated in an Example.

In the present specification, any component may include a plurality of materials corresponding the component. In the present specification, when reference is made to the amount of a component in a composition, if the composition contains a plurality of materials corresponding to the component, the amount means the total amount of the plurality of materials, unless otherwise specified.

Carrier for Electrostatic Image Development

A carrier for electrostatic image development according to a first exemplary embodiment includes: a core material; and a coating resin layer that contains inorganic particles and covers the core material. The content of the inorganic particles is from 10% by mass to 60% by mass inclusive based on the total mass of the coating resin layer. The volume average diameter D (μm) of the inorganic particles and the thickness T (μm) of the coating resin layer satisfy the following relational expression (1):

$$0.007 \leq D/T \leq 0.24. \qquad \text{relational expression (1)}$$

When images are formed over a long period of time, toners may scatter out of developing devices. The scattering toners tend to be accumulated on bearings of the developing devices. Therefore, in a high-temperature/high-humidity environment, the toners stick to the bearings, and the motor torque of each developing device tends to increase. This may cause irregular rotation of the motor, and density unevenness may occur in images.

In particular, when, after low-density images are printed continuously in a high-temperature/high-humidity environment and then the device used is left to stand for 24 hours, high-density images are printed continuously in a borderless printing mode, the charge distribution on toner particles tends to become worse due to mutual charging between the toner particles because fresh toner particles are added to toner particles with an external additive embedded therein, and therefore the toners tend to scatter. In this case, when the borderless printing mode is used, the amount of the toners supplied to non-sheet passing portion sides increases, and therefore the amount of the toners flying to the outside of the developing devices tends to increase, so that sticking of the toners to the bearings is likely to occur. When the toners stick to the bearings, irregular motor torque occurs, and density unevenness is likely to occur when half tone images are formed.

The carrier for electrostatic image development according to the first exemplary embodiment has the above-described structure and reduces the sticking of a toner to bearings of a developing device to thereby prevent the occurrence of density unevenness. Although the reason for this is unclear, the reason may be as follows.

The carrier for electrostatic image development according to the first exemplary embodiment satisfies relational expression (1) described above. Specifically, the inorganic particles are highly dispersible in the coating resin layer and contained at high density. Therefore, when images are formed over a long period of time, the coating resin layer is scraped from the carrier body, and the scraped pieces of the coating resin layer (hereinafter may be referred to also as "resin pieces") formed in a developing device are developed together with the toner. In this case, the resin pieces containing the inorganic particles are charged to a polarity opposite to the polarity of the toner. In particular, when the ratio of the inorganic particles in the coating resin layer is from 10% by mass to 60% by mass inclusive, proper hardness is imparted to the resin pieces. When the resin pieces having proper hardness and a polarity opposite to the polarity of the toner are developed in the developing device, they tend to be supplied to non-image portions, non-sheet passing portions, etc. and therefore tend to fly to the outside of the developing device. Therefore, the resin pieces tend to be supplied to a shaft portion of the developing device. Once the resin pieces adhere to the shaft, the toner is electrostatically repelled, and the accumulation of the toner tends to be reduced. This may prevent an increase in the degree of sticking of the toner to bearings, so that the occurrence of density unevenness in images may be prevented.

A carrier for electrostatic image development according to a second exemplary embodiment includes: a core material; and a coating resin layer that contains inorganic particles and covers the core material. When a mixture obtained by mixing 100 parts by mass of the carrier separated from an electrostatic image developer containing silica particles as an external additive for a toner and 10 parts by mass of a model toner using a turbula mixer at a temperature of 20° C. for a stirring time of 2 minutes is again separated into the carrier and the model toner using a gauge mesh, the liberation ratio of the silica particles from the surface of the carrier (the ratio=(S1−S2)/S1×100) is 500 or more. Here, S1 is the coverage of the surface of the carrier with the silica particles after separation from the electrostatic image developer but before mixing with the model toner, and S2 is the coverage of the surface of the carrier with the silica particles after separation from the model toner.

In a conventional carrier for electrostatic image development including a core material and a coating resin layer that contains inorganic particles and covers the core material, the liberation ratio of the silica particles is less than 50%. Specifically, the coating resin layer of the carrier is relatively soft, and resin pieces tend not to be formed. Therefore, when a developing device is used in a high-temperature/high-humidity environment, the degree of sticking of the toner to a bearing portion is likely to increase. This may cause irregular motor torque, so that density unevenness may occur in images.

However, as described above, in the carrier for electrostatic image development according to the second exemplary embodiment, the coating resin layer contains the inorganic particles, and the liberation ratio of the silica particles is 50% or more. Specifically, the coating resin layer of the carrier is properly hard, so that resin pieces tend to be formed. Moreover, the resin pieces containing the inorganic particles are charged to a polarity opposite to the polarity of the toner. Therefore, once the resin pieces having proper hardness and a polarity opposite to the polarity of the toner adhere to a shaft of a developing device, the toner is electrostatically repelled, and an increase in the degree of sticking of the toner to the bearings tends to be prevented. Thus, irregular motor torque due to sticking of the toner to the bearings may be unlikely to occur, and the occurrence of density unevenness in images may be prevented.

Features common to the first and second exemplary embodiments will be described as features in the present exemplary embodiment. The carrier for electrostatic image development may be referred to simply as the "carrier."

(Properties of carrier for electrostatic image development)

From the viewpoint of preventing density unevenness in images more effectively, the carrier in the present exemplary embodiment has a surface roughness Ra of preferably more than 0.1 μm and less than 0.9 μm, more preferably 0.11 μm or more and less than 0.85 μm, and still more preferably from 0.12 μm to 0.8 μm inclusive.

No particular limitation is imposed on the method for controlling the surface roughness Ra of the carrier. Examples of the method include: a method in which the surface roughness Ra of the core material is adjusted; a method in which the thickness of the coating resin layer is adjusted; and a method in which, when the carrier is produced, the rate of stirring a mixture of a resin forming the coating resin layer, the core material, the inorganic particles, and an optionally added solvent, the stirring speed, the stirring temperature, and the stirring time are adjusted.

In the present exemplary embodiment, the surface roughness Ra of the carrier is measured by the following method. In the method for measuring the Ra (arithmetic mean roughness) of the surface of the carrier, 2000 carrier particles and an ultra-depth color 3D profile measuring microscope (VK9700 manufactured by KEYENCE CORPORATION) are used, and the surfaces of the carrier particles are observed at a magnification of 1000× according to JIS B0601 (1994). Specifically, the Ra of the carrier surface is determined as follows. A roughness curve is determined from a three-dimensional profile of the carrier surface observed under the microscope, and the absolute values of deviations of the measurement values from the average value in the roughness curve are summed and averaged. The sampling length when the Ra of the carrier surface is determined is 10 μm, and the cutoff value is 0.08 mm.

From the viewpoint of preventing density unevenness in images more effectively, in the carrier according to the present exemplary embodiment, the volume average diameter D (μm) of the inorganic particles contained in the coating resin layer described later and the surface roughness Ra (μm) of the carrier surface satisfy preferably the following relational expression (2), more preferably the following relational expression (2-2), and still more preferably the following relational expression (2-3).

$$0.003<D/Ra<0.50 \quad \text{Relational expression (2)}$$

$$0.005\leq D/Ra\leq 0.40 \quad \text{Relational expression (2-2)}$$

$$0.010\leq D/Ra\leq 0.20 \quad \text{Relational expression (2-3)}$$

No particular limitation is imposed on the method for controlling the volume average diameter D (μm) of the inorganic particles contained in the coating resin layer and the surface roughness Ra (μm) of the carrier surface such that these satisfy the relational expression (2), (2-2), or (2-3). Examples of the method include: a method in which the surface roughness Ra of the core material is adjusted; a method in which the thickness of the coating resin layer is adjusted; and a method in which the volume average diameter D of the inorganic particles is adjusted.

In the carrier according to the second exemplary embodiment, when a mixture obtained by mixing 100 parts by mass of the carrier separated from an electrostatic image developer containing silica particles as an external additive for a toner and 10 parts by mass of a model toner using a turbula mixer at a temperature of 20° C. for a stirring time of 2 minutes is again separated into the carrier and the model toner using a gauge mesh, the liberation ratio of the silica particles from the surface of the carrier (the ratio=(S1−S2)/S1×100) is 50% or more, preferably 55% or more, and more preferably 60% or more. Here, S1 is the coverage of the surface of the carrier with the silica particles after separation from the electrostatic image developer but before mixing with the model toner, and S2 is the coverage of the surface of the carrier with the silica particles after separation from the model toner.

The above liberation ratio is determined as follows.

(1) An air jet sieve is used to separate the toner and the carrier from the electrostatic image developer containing the silica particles as the external additive for the toner.

(2) The coverage S1 of the surface of the carrier separated from the electrostatic image developer with the silica particles is determined by X-ray photoelectron spectroscopy (XPS) using the following method.

The carrier is observed under a scanning electron microscope (SEM, S-4800 manufactured by Hitachi High-Technologies Corporation) equipped with an energy dispersive X-ray analyzer (EDX analyzer, EMAX Evolution X-Max 80 $mm^2$ manufactured by HORIBA Ltd.), and an image is taken at a magnification of 40000×. In this case, EDX analysis is used to identify primary particles of silica in one image field based on the presence of Si. In the SEM observation, an acceleration voltage of 15 kV, an emission current of 20 μA, and a WD of 15 mm are used. In the EDX analysis, a detection time of 60 minutes is used under the above conditions. The image obtained is transferred to an image analyzer (LUZEX III manufactured by NIRECO CORPORATION), and the areas of the particles are determined by image analysis.

The ratio of the total area of the silica particles to the total surface area of the carrier (the total area of the silica particles/the total surface area of the carrier×100) is defined as the coverage S1 of the surface of the carrier with the silica particles after separation from the electrostatic image developer.

(3) The model toner used is a toner having the following structure and including no external additive.

Binder resin: amorphous polyester resin

Volume average diameter: 5.7 μm

Volume average particle size distribution index (GSDv): 1.20

Average circularity: from 9.55 to 9.74 inclusive (4) 100 Parts by mass of the carrier separated in step (1) and 10 parts by mass of the model toner described in step (3) are mixed, and the mixture is stirred using a turbula mixer at a temperature of 20° C. and a humidity of 50% RH for a stirring time of 2 minutes.

(5) A gauge mesh (manufactured by ASADA MESH CO., LTD.) is used to separate the mixture into the model toner and the carrier.

(6) The coverage S2 of the carrier surface with the silica particles after separation from the model toner is determined by XPS in the same manner as for the coverage S1 with the silica particles.

(7) The "coverage S1 of the surface of the carrier with the silica particles after separation from the electrostatic image developer but before mixing with the model toner" and the "coverage S2 of the surface of the carrier with the silica particles after separation from the model toner" are used to determine the liberation ratio of the silica particles covering the carrier surface (=(S1−S2)/S1×100).

[Core Material]

The carrier for electrostatic image development according to the present exemplary embodiment includes the core material.

No particular limitation is imposed on the core material so long as it has magnetism, and a well-known material used as a core material of a carrier may be used.

Examples of the core material include: particulate magnetic powders (magnetic particles); resin-impregnated magnetic particles obtained by impregnating a porous magnetic powder with a resin; and magnetic powder-dispersed resin particles obtained by dispersing a magnetic powder in a resin.

Examples of the magnetic powder include: particles of magnetic metals such as iron, nickel, and cobalt; and magnetic oxides such as ferrite and magnetite. The magnetic powder may be a magnetic oxide. One type of magnetic particles may be used alone, or a combination of two or more types may be used.

Examples of the resin forming the core material include polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymers, styrene-acrylic acid copolymers, straight silicones having organosiloxane bonds and modified products thereof, fluorocarbon resins, polyesters, polycarbonates, phenolic resins, and epoxy resins. One of these resins may be used alone, or two or more of them may be used in combination. The resin forming the core material may contain an additive such as electrically conductive particles. Examples of the electrically conductive particles include: particles of metals such as gold, silver, and copper; and particles of carbon black, titanium oxide, zinc oxide, tin oxide, barium sulfate, aluminum borate, and potassium titanate.

The core material may be a particulate magnetic powder, i.e., magnetic particles.

The surface roughness Ra of the core material is preferably from 0.5 μm to 1.5 μm inclusive, more preferably from 0.6 μm to 1.2 μm inclusive, and still more preferably from 0.7 μm to 1.0 μm inclusive.

No particular limitation is imposed on the method for adjusting the surface roughness Ra of the core material within the above range. Examples of the method include a method in which the core material is produced using a wet ball mill and the particle size of the raw material of the core material or the size of particles obtained by pulverizing the sintered product of the raw material is adjusted.

The surface roughness Ra of the core material is measured in the same manner as for the surface roughness Ra of the carrier described above.

The volume average diameter of the magnetic particles may be, for example, from 20 μm to 50 μm inclusive.

[Coating Resin Layer]

The coating resin layer in the present exemplary embodiment contains the inorganic particles.

The coating resin layer in the present exemplary embodiment is a resin layer that covers the core material.

In the coating resin layer in the first exemplary embodiment, the volume average diameter D (μm) of the inorganic particles and the thickness T (μm) of the coating resin layer satisfy relational expression (1) below. From the viewpoint of preventing density unevenness in images more effectively, the volume average diameter D (μm) and the thickness T (μm) satisfy preferably relational expression (1-2) below and more preferably relational expression (1-3).

$$0.007 \leq D/T \leq 0.24 \quad \text{Relational expression (1)}$$

$$0.007 \leq D/T \leq 0.2 \quad \text{Relational expression (1-2)}$$

$$0.007 \leq D/T \leq 0.05 \quad \text{Relational expression (1-3)}$$

In the coating resin layer in the second exemplary embodiment, the volume average diameter D (μm) of the inorganic particles and the thickness T (μm) of the coating resin layer satisfy preferably the above relational expression (1), more preferably the above relational expression (1-2), and still more preferably the above relational expression (1-3).

No particular limitation is imposed on the method for forming the coating resin layer that satisfies the above relational expression (1), (1-2), or (1-3). Examples of the method include: a method in which the type of resin forming the coating resin layer is adjusted; and a method in which the diameter of the inorganic particles is adjusted.

(Resin)

Examples of the resin forming the coating resin layer include: styrene-acrylic acid copolymers; polyolefin resins such as polyethylene and polypropylene; polyvinyl and polyvinylidene resins such as polystyrene, acrylic resins, polyacrylonitrile, polyvinyl acetate, polyvinyl alcohol, polyvinyl butyral, polyvinyl chloride, polyvinylcarbazole, polyvinyl ether, and polyvinyl ketone; vinyl chloride-vinyl acetate copolymers; straight silicone resins having organosiloxane bonds and modified products thereof; fluorocarbon resins such as polytetrafluoroethylene, polyvinyl fluoride, polyvinylidene fluoride, and polychlorotrifluoroethylene; polyesters; polyurethanes; polycarbonates; amino resins such as urea-formaldehyde resins; and epoxy resins.

The coating resin layer may contain an alicyclic (meth) acrylic resin. When the coating resin layer contains an alicyclic (meth)acrylic resin, the dispersibility of the inorganic particles contained in the coating resin layer tends to be high, and resin pieces containing the inorganic particles tend to be generated efficiently. Therefore, density unevenness in images tends to be prevented more effectively.

The monomer component of the alicyclic (meth)acrylic resin may be a lower alkyl ester of (meth)acrylic acid (e.g., an alkyl (meth)acrylate in which the number of carbon atoms in the alkyl group is from 1 to 9 inclusive). Specific examples include methyl (meth)acrylate, ethyl (meth)acrylate, propyl (meth)acrylate, butyl (meth)acrylate, hexyl (meth)acrylate, cyclohexyl (meth)acrylate, 2-ethylhexyl (meth)acrylate, and 2-(dimethylamino)ethyl (meth)acrylate.

In particular, from the viewpoint of preventing density unevenness in images more effectively, the alicyclic (meth) acrylic resin contains, as the monomer component, preferably at least one selected from the group consisting of methyl (meth)acrylate, cyclohexyl (meth)acrylate, and 2-(dimethylamino)ethyl (meth)acrylate and more preferably at least one of methyl (meth)acrylate and cyclohexyl (meth) acrylate. One monomer component may be used for the alicyclic (meth)acrylic resin, or a combination of two or more may be used.

The alicyclic (meth)acrylic resin blocks the influence of water on a polarization component of the bond between carbon and oxygen atoms through the steric hindrance of the alicyclic functional group. The alicyclic (meth)acrylic resin may contain cyclohexyl (meth)acrylate as the monomer component because the influence of water when an environmental change occurs can be reduced.

The content of cyclohexyl (meth)acrylate contained in the alicyclic (meth)acrylic resin is preferably from 75% by mole to 100% by mole inclusive, more preferably from 90% by mole to 100% by mole inclusive, and still more preferably from 95% by mole to 100% by mole inclusive.

The ratio of the mass of the alicyclic (meth)acrylic resin to the total mass of the resins contained in the coating resin layer is preferably 80% by mass or more, more preferably 90% by mass or more, and still more preferably 95% by mass or more.

(Inorganic Particles)

Examples of the inorganic particles include particles of silica, alumina, titanium oxide (titania), barium titanate, magnesium titanate, calcium titanate, strontium titanate, iron oxide, copper oxide, zinc oxide, tin oxide, silica sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide, and silicon nitride. In particular, from the viewpoint of preventing density unevenness in images more effectively, the inorganic particles include preferably particles of at least one selected from the group consisting of silica, alumina, and titanium oxide and include more preferably silica particles.

The inorganic particles include preferably inorganic particles subjected to hydrophobic treatment with a hydrophobic treatment agent and more preferably silica particles subjected to hydrophobic treatment.

The hydrophobic treatment agent may be a well-known surface treatment agent, and specific examples include silane coupling agents and silicone oils.

Examples of the silane coupling agent include: hexamethyldisilazane, trimethylsilane, trimethylchlorosilane, dimethyldichlorosilane, methyltrichlorosilane, allyldimethylchlorosilane, benzyldimethylchlorosilane, methyltrimethoxysilane, methyltriethoxysilane, isobutyltrimethoxysilane, dimethyldimethoxysilane, dimethyldiethoxysilane, trimethylmethoxysilane, hydroxypropyltrimethoxysilane, phenyltrimethoxysilane, n-butyltrimethoxysilane, n-hexadecyltrimethoxysilane, n-octadecyltrimethoxysilane, vinyltrimethoxysilane, vinyltriethoxysilane, γ-methacryloxypropyltrimethoxysilane, and vinyltriacetoxysilane.

Examples of the silicone oil include dimethylpolysiloxane, methylhydrogenpolysiloxane, and methylphenylpolysiloxane.

In particular, the hydrophobic treatment agent contains preferably at least one of hexamethyldisilazane (HMDS) and dimethylpolysiloxane (PDMS) and more preferably HMDS.

The volume average diameter D of the inorganic particles is preferably from 1 nm to 80 nm inclusive, more preferably from 5 nm to 50 nm inclusive, and still more preferably from 5 nm to 30 nm inclusive.

The volume average diameter D of the inorganic particles is determined by observing the surface of the carrier under a scanning electron microscope and subjecting images of inorganic particles adhering to the coating resin layer to image analysis. Specifically, 50 inorganic particles per carrier particle are observed under the scanning electron microscope. Image analysis is performed to measure the maximum and minimum diameters of each of the inorganic particles, and the sphere-equivalent diameter is determined from the intermediate value of the maximum and minimum diameters. The measurement of the sphere-equivalent diameter is performed on 100 carrier particles. Then the 50% diameter (D50v) in a volume-based cumulative frequency distribution of the sphere-equivalent diameters obtained is used as the volume average diameter D of the inorganic particles.

The content of the inorganic particles in the first exemplary embodiment is from 10% by mass to 60% by mass inclusive, preferably from 10% by mass to 50% by mass inclusive, and more preferably from 10% by mass to 40% by mass inclusive based on the total mass of the coating resin layer.

The content of the inorganic particles in the second exemplary embodiment is preferably from 10% by mass to 60% by mass inclusive, more preferably from 10% by mass to 50% by mass inclusive, and still more preferably from 10% by mass to 40% by mass inclusive based on the total mass of the coating resin layer.

Examples of the method for forming the coating resin layer on the core material surface include a wet production method and a dry production method. The wet production method uses a solvent that can dissolve or disperse the resin forming the coating resin layer. The dry production method does not use the solvent.

Examples of the dry production method include: an immersion method in which the core material is immersed in a resin solution for forming the coating resin layer to thereby coat the core material with the resin; a spray method in which the resin solution for forming the coating resin layer is sprayed onto the surface of the core material; a fluidized bed method in which the resin solution for forming the coating resin layer is sprayed onto the core material floating in a fluidized bed; and a kneader-coater method in which the core material and the resin solution for forming the coating resin layer are mixed in a kneader coater and then the solvent is removed.

The resin solution for forming the coating resin layer used in the wet production method is prepared by dissolving or dispersing the resin and an additional component in the solvent. No particular limitation is imposed on the solvent, so long as it can dissolve or disperse the resin. Examples of the solvent include: aromatic hydrocarbons such as toluene and xylene; ketones such as acetone and methyl ethyl ketone; and ethers such as tetrahydrofuran and dioxane.

Examples of the dry production method include a method in which a dry mixture of the core material and the resin for forming the coating resin layer is heated to form the coating resin layer. Specifically, for example, the core material and the resin for forming the coating resin layer are mixed in air and heat-fused to form the coating resin layer.

The thickness T (μm) of the coating resin layer is preferably from 0.1 μm to 10 μm inclusive, more preferably from 0.2 μm to 5 μm inclusive, and still more preferably from 0.3 μm to 3 μm inclusive.

The thickness T of the coating resin layer is measured by the following method. The carrier is embedded in, for example, an epoxy resin and cut with, for example, a diamond knife to thereby produce a thin slice. The thin slice is observed under, for example, a transmission electron macroscope (TEM), and cross-sectional images of a plurality of carrier particles are taken. The thickness of the coating resin layer is measured at 20 points in the cross-sectional images of the carrier particles, and the average of the measured values is used.

Electrostatic Image Developer

A developer according to an exemplary embodiment contains a toner and the carrier according to the preceding exemplary embodiment.

The developer according to the present exemplary embodiment is prepared by mixing the toner and the carrier according to the preceding exemplary embodiment at an appropriate mixing ratio. The mixing ratio (mass ratio) of the toner to the carrier (toner:carrier) is preferably 1:100 to 30:100 and more preferably 3:100 to 20:100.

[Toner for Electrostatic Image Development]

No particular limitation is imposed on the toner, and any known toner is used. Examples of the toner include: a color toner including toner particles containing a binder resin and a coloring agent; and an infrared absorbing toner that uses an infrared absorber instead of the coloring agent. The toner may contain a release agent, various internal and external additives, etc.

—Binder Resin—

Examples of the binder resin include: vinyl resins composed of homopolymers of monomers such as styrenes (such as styrene, p-chlorostyrene, and α-methylstyrene), (meth) acrylates (such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (such as acrylonitrile and methacrylonitrile), vinyl ethers (such as vinyl methyl ether and vinyl isobutyl ether), vinyl ketones (such as vinyl methyl ketone, vinyl ethyl ketone, and vinyl isopropenyl ketone), and olefins (such as ethylene, propylene, and butadiene); and vinyl resins composed of copolymers of combinations of two or more of the above monomers.

Other examples of the binder resin include: non-vinyl resins such as epoxy resins, polyester resins, polyurethane resins, polyamide resins, cellulose resins, polyether resins, and modified rosins; mixtures of the non-vinyl resins and the above-described vinyl resins; and graft polymers obtained by polymerizing a vinyl monomer in the presence of any of these resins.

One of these binder resins may be used, or two or more of them may be used in combination.

The binder resin may be a polyester resin. The polyester resin is, for example, any known polyester resin.

The glass transition temperature (Tg) of the polyester resin is preferably from 50° C. to 80° C. inclusive and more preferably from 50° C. to 65° C. inclusive.

The glass transition temperature is determined using a DSC curve obtained by differential scanning calorimetry (DSC). More specifically, the glass transition temperature is determined from "extrapolated glass transition onset temperature" described in a glass transition temperature determination method in "Testing methods for transition temperatures of plastics" in JIS K7121-1987.

The weight average molecular weight (Mw) of the polyester resin is preferably from 5000 to 1000000 inclusive and more preferably from 7000 to 500000 inclusive. The number average molecular weight (Mn) of the polyester resin may be from 2000 to 100000 inclusive. The molecular weight distribution Mw/Mn of the polyester resin is preferably from 1.5 to 100 inclusive and more preferably from 2 to 60 inclusive.

The weight average molecular weight and the number average molecular weight are measured by gel permeation chromatography (GPC). In the molecular weight distribution measurement by GPC, a GPC measurement apparatus HLC-8120GPC manufactured by TOSOH Corporation is used. A TSKgel Super HM-M (15 cm) column manufactured by TOSOH Corporation and a THF solvent are used. The weight average molecular weight and the number average molecular weight are computed from the measurement results using a molecular weight calibration curve produced using monodispersed polystyrene standard samples.

The content of the binder resin is preferably from 40% by mass to 95% by mass inclusive, more preferably from 50% by mass to 90% by mass inclusive, and still more preferably from 60% by mass to 85% by mass inclusive based on the total mass of the toner particles.

—Coloring Agent—

Examples of the coloring agent include: pigments such as carbon black, chrome yellow, hansa yellow, benzidine yellow, threne yellow, quinoline yellow, pigment yellow, permanent orange GTR, pyrazolone orange, vulcan orange, watchung red, permanent red, brilliant carmine 3B, brilliant carmine 6B, DuPont oil red, pyrazolone red, lithol red, rhodamine B lake, lake red C, pigment red, rose bengal, aniline blue, ultramarine blue, calco oil blue, methylene blue chloride, phthalocyanine blue, pigment blue, phthalocyanine green, and malachite green oxalate; and dyes such as acridine-based dyes, xanthene-based dyes, azo-based dyes, benzoquinone-based dyes, azine-based dyes, anthraquinone-based dyes, thioindigo-based dyes, dioxazine-based dyes, thiazine-based dyes, azomethine-based dyes, indigo-based dyes, phthalocyanine-based dyes, aniline black-based dyes, polymethine-based dyes, triphenylmethane-based dyes, diphenylmethane-based dyes, and thiazole-based dyes.

One coloring agent may be used alone, or two or more coloring agents may be used in combination.

The coloring agent used may be optionally subjected to surface treatment or may be used in combination with a dispersant. A plurality of coloring agents may be used in combination.

The content of the coloring agent is preferably from 1% by mass to 30% by mass inclusive and more preferably from 3% by mass to 15% by mass inclusive based on the total mass of the toner particles.

—Release Agent—

Examples of the release agent include: hydrocarbon-based waxes; natural waxes such as carnauba wax, rice wax, and candelilla wax; synthetic and mineral/petroleum-based waxes such as montan wax; and ester-based waxes such as fatty acid esters and montanic acid esters. However, the release agent is not limited to these waxes.

The melting temperature of the release agent is preferably from 50° C. to 110° C. inclusive and more preferably from 60° C. to 100° C. inclusive.

The melting temperature is determined using a DSC curve obtained by differential scanning calorimetry (DSC) from "peak melting temperature" described in a melting temperature determination method in "Testing methods for transition temperatures of plastics" in JIS K7121-1987.

The content of the release agent is preferably from 1% by mass to 20% by mass inclusive and more preferably from 5% by mass to 15% by mass inclusive based on the total mass of the toner particles.

—Additional Additives—

Examples of additional additives include well-known additives such as a magnetic material, a charge control agent, and an inorganic powder. These additives are contained in the toner particles as internal additives.

—Characteristics Etc. of Toner Particles—

The toner particles may have a single layer structure or may have a so-called core-shell structure including a core (core particle) and a coating layer (shell layer) covering the core. Toner particles having the core-shell structure may each include, for example: a core containing a binder resin and optional additives such as a coloring agent and a release agent; and a coating layer containing a binder resin.

The volume average particle diameter (D50v) of the toner particles is preferably from 2 μm to 10 μm inclusive and more preferably from 4 μm to 8 μm inclusive.

The volume average particle diameter (D50v) of the toner particles is measured using Coulter Multisizer II (manufactured by Beckman Coulter, Inc.), and ISOTON-II (manufactured by Beckman Coulter, Inc.) is used as an electrolyte. In the measurement, 0.5 mg to 50 mg of a measurement sample is added to 2 mL of a 5% by mass aqueous solution of a surfactant (which may be sodium alkylbenzenesulfonate) serving as a dispersant. The mixture is added to 100 mL to 150 mL of the electrolyte. The electrolyte with the sample suspended therein is subjected to dispersion treatment for 1 minute using an ultrasonic dispersion apparatus, and then the particle size distribution of particles having diameters within the range of 2 μm to 60 μm is measured using an aperture having an aperture diameter of 100 μm in the Coulter Multisizer II. The number of particles sampled is 50000.

—External Additives—

Examples of the external additives include inorganic particles. Examples of the inorganic particles include particles of $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)$ $Al_2O_3.2SiO_2$, $CaCO_3$, $MgCO_3$, $BaSO_4$, and $MgSO_4$.

The surfaces of the inorganic particles used as the external additive may be subjected to hydrophobic treatment. The hydrophobic treatment is performed, for example, by immersing the inorganic particles in a hydrophobic treatment agent. No particular limitation is imposed on the hydrophobic treatment agent. Examples of the hydrophobic treatment agent include silane-based coupling agents, silicone oils, titanate-based coupling agents, and aluminum-based coupling agents. These may be used alone or in combination of two or more.

The amount of the hydrophobic treatment agent is generally, for example, from 1 part by mass to 10 parts by mass inclusive based on 100 parts by mass of the inorganic particles.

Other examples of the external additives include resin particles (particles of resins such as polystyrene, polymethyl methacrylate, and melamine resin) and a cleaning lubricant (a metal salt of a higher fatty acid typified by zinc stearate or particles of a fluorine-based high-molecular weight material).

The amount of the external additives is preferably from 0.01% by mass to 5% by mass inclusive and more preferably from 0.01% by mass to 2.0% by mass inclusive based on the mass of the toner particles.

—Method for Producing Toner—

The toner is obtained by externally adding the external additives to the toner particles produced. The toner particles may be produced by a dry production method (such as a kneading-grinding method) or by a wet production method (such as an aggregation/coalescence method or a dissolution/suspension method). No particular limitation is imposed on the production method, and any known production method may be used. In particular, the aggregation/coalescence method may be used to obtain the toner particles.

Image Forming Apparatus and Image Forming Method

An image forming apparatus and an image forming method in an exemplary embodiment will be described.

The image forming apparatus in the present exemplary embodiment includes: an image holding member; charging means for charging the surface of the image holding member; electrostatic image forming means for forming an electrostatic image on the charged surface of the image holding member; developing means that contains an electrostatic image developer and develops the electrostatic image formed on the surface of the image holding member with the electrostatic image developer to thereby form a toner image; transferring means for transferring the toner image formed on the surface of the image holding member onto a recording medium; and fixing means for fixing the toner image transferred onto the recording medium. The electrostatic image developer used is the electrostatic image developer according to the preceding exemplary embodiment.

In the image forming apparatus in the present exemplary embodiment, an image forming method (an image forming method in the present exemplary embodiment) is performed. The image forming method includes: charging the surface of the image holding member; forming an electrostatic image on the charged surface of the image holding member; developing the electrostatic image formed on the surface of the image holding member with the electrostatic image developer according to the preceding exemplary embodiment to thereby form a toner image; transferring the toner image formed on the surface of the image holding member onto a recording medium; and fixing the toner image transferred onto the surface of the recording medium.

The image forming apparatus in the present exemplary embodiment may be applied to known image forming apparatuses such as: a direct transfer-type apparatus that transfers a toner image formed on the surface of the image holding member directly onto a recording medium; an intermediate transfer-type apparatus that first-transfers a toner image formed on the surface of the image holding member onto the surface of an intermediate transfer body and second-transfers the toner image transferred onto the surface of the intermediate transfer body onto the surface of a recording medium; an apparatus including cleaning means for cleaning the surface of the image holding member after the transfer of the toner image but before charging; and an apparatus including charge eliminating means for eliminating charges on the surface of the image holding member after transfer of the toner image but before charging by irradiating the surface of the image holding member with charge eliminating light.

When the image forming apparatus in the present exemplary embodiment is the intermediate transfer-type apparatus, the transferring means includes, for example: an intermediate transfer body having a surface onto which a toner image is to be transferred; first transferring means for first-transferring a toner image formed on the surface of the image holding member onto the surface of the intermediate transfer body; and second transferring means for second-transferring the toner image transferred onto the surface of the intermediate transfer body onto the surface of a recording medium.

In the image forming apparatus in the present exemplary embodiment, for example, a portion including the developing means may have a cartridge structure (process cartridge) that is detachably attached to the image forming apparatus. The process cartridge used may be, for example, a process cartridge that contains the electrostatic image developer according to the preceding exemplary embodiment and includes the developing means.

An example of the image forming apparatus in the present exemplary embodiment will be described, but this is not a limitation. In the following description, major components shown in FIG. 1 will be described, and description of other components will be omitted.

FIG. 1 a schematic configuration diagram showing the image forming apparatus in the present exemplary embodiment.

The image forming apparatus shown in FIG. 1 includes first to fourth electrophotographic image forming units 10Y, 10M, 10C, and 10K (image forming means) that output yellow (Y), magenta (M), cyan (C), and black (K) images, respectively, based on color-separated image data. These image forming units (hereinafter may be referred to simply as "units") 10Y, 10M, 10C, and 10K are arranged so as to be spaced apart from each other horizontally by a prescribed distance. These units 10Y, 10M, 10C, and 10K may each be a process cartridge detachably attached to the image forming apparatus.

An intermediate transfer belt (an example of the intermediate transfer body) 20 is disposed above the units 10Y, 10M, 10C, and 10K so as to extend through these units. The intermediate transfer belt 20 is wound around a driving roller 22 and a support roller 24 and runs in a direction from the first unit 10Y toward the fourth unit 10K. A force is applied to the support roller 24 by, for example, an unillustrated spring in a direction away from the driving roller 22, so that a tension is applied to the intermediate transfer belt 20 wound around the rollers. An intermediate transfer body cleaner 30 is disposed on an image holding member-side surface of the intermediate transfer belt 20 so as to be opposed to the driving roller 22.

Yellow, magenta, cyan, and black toners contained in toner cartridges 8Y, 8M, 8C, and 8K, respectively, are supplied to developing devices (examples of the developing means) 4Y, 4M, 4C, and 4K, respectively, of the units 10Y, 10M, 10C, and 10K.

The first to fourth units 10Y, 10M, 10C, and 10K have the same structure and operate similarly. Therefore, the first unit 10Y that is disposed upstream in the running direction of the intermediate transfer belt and forms a yellow image will be described as a representative unit.

The first unit 10Y includes a photoconductor 1Y serving as an image holding member. A charging roller (an example of the charging means) 2Y, an exposure unit (an example of the electrostatic image forming means) 3, a developing device (an example of the developing means) 4Y, a first transfer roller 5Y (an example of the first transferring means), and a photoconductor cleaner (an example of the cleaning means) 6Y are disposed around the photoconductor 1Y in this order. The charging roller charges the surface of the photoconductor 1Y to a prescribed potential, and the exposure unit 3 exposes the charged surface to a laser beam 3Y according to a color-separated image signal to thereby form an electrostatic image. The developing device 4Y supplies a charged toner to the electrostatic image to develop the electrostatic image, and the first transfer roller 5Y transfers the developed toner image onto the intermediate transfer belt 20. The photoconductor cleaner 6Y removes the toner remaining on the surface of the photoconductor 1Y after the first transfer.

The first transfer roller 5Y is disposed on the inner side of the intermediate transfer belt 20 and placed at a position opposed to the photoconductor 1Y. Bias power sources (not shown) for applying a first transfer bias are connected to the respective first transfer rollers 5Y, 5M, 5C, and 5K of the units. The bias power sources are controlled by an unillustrated controller to change the values of transfer biases applied to the respective first transfer rollers.

A yellow image formation operation in the first unit 10Y will be described.

First, before the operation, the surface of the photoconductor 1Y is charged by the charging roller 2Y to a potential of −600 V to −800 V.

The photoconductor 1Y is formed by stacking a photosensitive layer on a conductive substrate (with a volume resistivity of, for example, $1\times10^{-6}$ Ωcm or less at 20° C.). The photosensitive layer generally has a high resistance (the resistance of a general resin) but has the property that, when irradiated with a laser beam, the specific resistance of a portion irradiated with the laser beam is changed. Therefore, the charged surface of the photoconductor 1Y is irradiated with a laser beam 3Y from the exposure unit 3 according to yellow image data sent from an unillustrated controller. An electrostatic image with a yellow image pattern is thereby formed on the surface of the photoconductor 1Y.

The electrostatic image is an image formed on the surface of the photoconductor 1Y by charging and is a negative latent image formed as follows. The specific resistance of the irradiated portions of the photosensitive layer irradiated with the laser beam 3Y decreases, and this causes charges on the surface of the photoconductor 1Y to flow. However, the charges in portions not irradiated with the laser beam 3Y remain present, and the electrostatic image is thereby formed.

The electrostatic image formed on the photoconductor 1Y rotates to a prescribed developing position as the photoconductor 1Y rotates. Then the electrostatic image on the photoconductor 1Y at the developing position is developed and visualized as a toner image by the developing device 4Y.

An electrostatic image developer containing, for example, at least a yellow toner and a carrier is contained in the developing device 4Y. The yellow toner is agitated in the developing device 4Y and thereby frictionally charged. The charged yellow toner has a charge with the same polarity (negative polarity) as the charge on the photoconductor 1Y and is held on a developer roller (an example of a developer holding member). As the surface of the photoconductor 1Y passes through the developing device 4Y, the yellow toner electrostatically adheres to charge-eliminated latent image portions on the surface of the photoconductor 1Y, and the latent image is thereby developed with the yellow toner. Then the photoconductor 1Y with the yellow toner image formed thereon continues running at a prescribed speed, and the toner image developed on the photoconductor 1Y is transported to a prescribed first transfer position.

When the yellow toner image on the photoconductor 1Y is transported to the first transfer position, a first transfer bias is applied to the first transfer roller 5Y, and an electrostatic force directed from the photoconductor 1Y toward the first transfer roller 5Y acts on the toner image, so that the toner image on the photoconductor 1Y is transferred onto the intermediate transfer belt 20. The transfer bias applied in this case has a (+) polarity opposite to the (−) polarity of the toner and is controlled to, for example, +10 μA in the first unit 10Y by the controller (not shown).

The toner remaining on the photoconductor 1Y is removed and collected by the photoconductor cleaner 6Y.

The first transfer biases applied to first transfer rollers 5M, 5C, and 5K of the second unit 10M and subsequent units are controlled in the same manner as in the first unit.

The intermediate transfer belt 20 with the yellow toner image transferred thereon in the first unit 10Y is sequentially transported through the second to fourth units 10M, 10C and 10K, and toner images of respective colors are superimposed and multi-transferred.

Then the intermediate transfer belt 20 with the four color toner images multi-transferred thereon in the first to fourth units reaches a secondary transfer portion that is composed of the intermediate transfer belt 20, the support roller 24 in contact with the inner surface of the intermediate transfer belt, and a secondary transfer roller (an example of the second transferring means) 26 disposed on the image holding surface side of the intermediate transfer belt 20. A recording paper sheet (an example of the recording medium) P is supplied to a gap between the secondary transfer roller 26 and the intermediate transfer belt 20 in contact with each other at a prescribed timing through a supply mechanism, and a secondary transfer bias is applied to the support roller 24. The transfer bias applied in this case has the same polarity (−) as the polarity (−) of the toner, and an electrostatic force directed from the intermediate transfer belt 20 toward the recording paper sheet P acts on the toner image, so that the toner image on the intermediate transfer belt 20 is transferred onto the recording paper sheet P. In this case, the secondary transfer bias is determined according to a resistance detected by resistance detection means (not shown) for detecting the resistance of the secondary transfer portion and is voltage-controlled.

Then the recording paper sheet P is transported to a press contact portion (nip portion) of a pair of fixing rollers in a fixing device (an example of the fixing means) 28, and the toner image is fixed onto the recording paper sheet P to thereby form a fixed image.

Examples of the recording paper sheet P onto which a toner image is to be transferred include plain paper sheets used for electrophotographic copying machines, printers, etc. Examples of the recording medium include, in addition to the recording paper sheets P, transparencies.

To further improve the smoothness of the surface of a fixed image, it may be necessary that the surface of the recording paper sheet P be smooth. For example, coated paper prepared by coating the surface of plain paper with, for example, a resin, art paper for printing, etc. are suitably used.

The recording paper sheet P with the color image fixed thereon is transported to an ejection portion, and a series of the color image formation operations is thereby completed.

Process Cartridge

A process cartridge in an exemplary embodiment will be described.

The process cartridge according to the present exemplary embodiment includes developing means that contains the electrostatic image developer according to the preceding exemplary embodiment and develops an electrostatic image formed on the surface of an image holding member with the electrostatic image developer to thereby form a toner image. The process cartridge is detachably attached to the image forming apparatus.

The structure of the process cartridge according to the present exemplary embodiment is not limited to the above described structure. The process cartridge may include, in addition to the developing means, at least one optional unit selected from other means such as an image holding member, charging means, electrostatic image forming means, and transferring means.

An example of the process cartridge according to the present exemplary embodiment will be described, but this is not a limitation. In the following description, major components shown in FIG. 2 will be described, and description of other components will be omitted.

Figure 2:
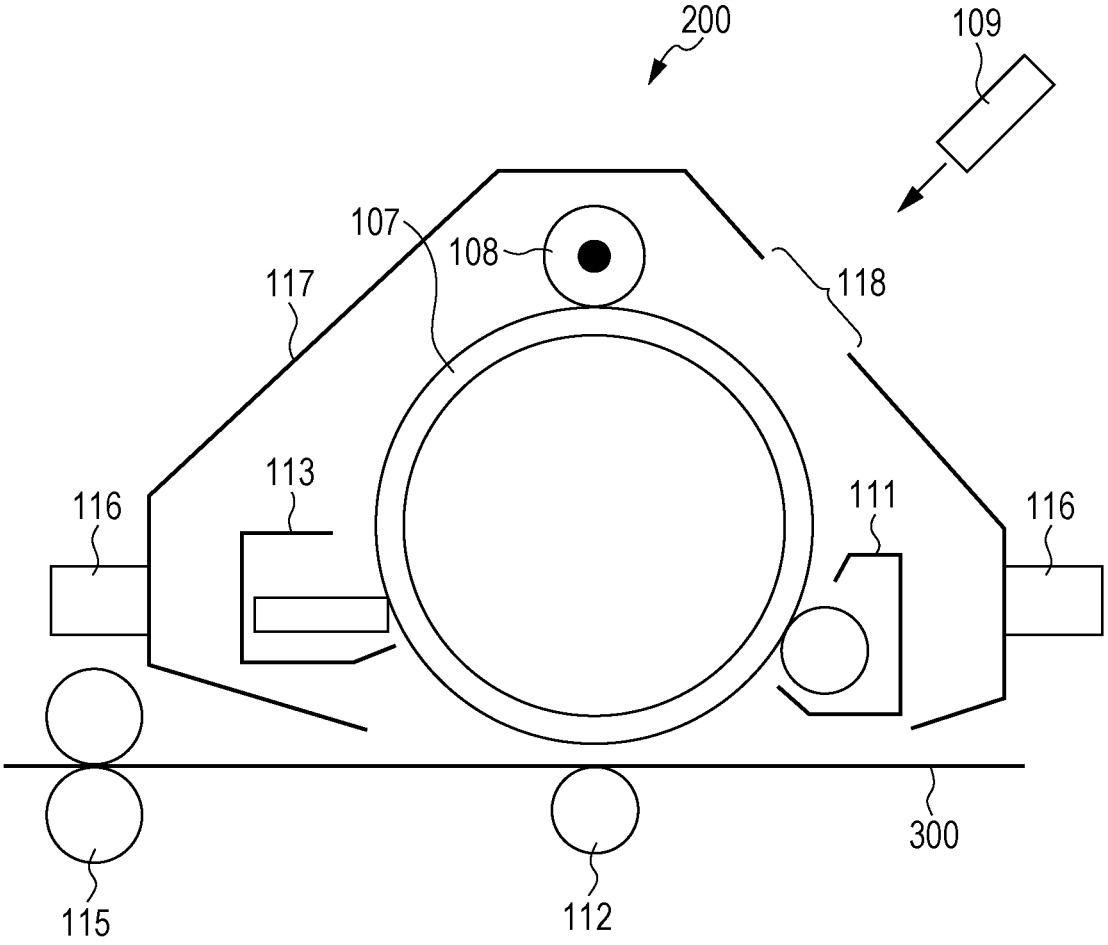
FIG. 2 is a schematic configuration diagram showing an example of a process cartridge detachably attached to the image forming apparatus according to the exemplary embodiment.

FIG. 2 is a schematic configuration diagram showing the process cartridge according to the present exemplary embodiment.

The process cartridge 200 shown in FIG. 2 includes, for example, a housing 117 including mounting rails 116 and an opening 118 for light exposure and further includes a photoconductor 107 (an example of the image holding member), a charging roller 108 (an example of the charging means) disposed on the circumferential surface of the photoconductor 107, a developing device 111 (an example of the developing means), and a photoconductor cleaner 113 (an example of the cleaning means), which are integrally combined and held in the housing 117 to thereby form a cartridge.

In FIG. 2, 109 denotes an exposure unit (an example of the electrostatic image forming means), and 112 denotes a transferring device (an example of the transferring means). 115 denotes a fixing device (an example of the fixing means), and 300 denotes a recording paper sheet (an example of the recording medium).

EXAMPLES

The exemplary embodiments of the disclosure will be described in detail by way of Examples. However, the exemplary embodiments of the disclosure are not limited to these Examples. In the following description, "parts" and are based on mass, unless otherwise specified.

Production of Toner

[Preparation of Resin Particle Dispersion (1)]

| | |
|---|---|
| Ethylene glycol (FUJIFILM Wako Pure Chemical Corporation) | 37 parts |
| Neopentyl glycol (FUJIFILM Wako Pure Chemical Corporation) | 65 parts |
| 1,9-Nonanediol (FUJIFILM Wako Pure Chemical Corporation) | 32 parts |
| Terephthalic acid (FUJIFILM Wako Pure Chemical Corporation) | 96 parts |

The above materials are placed in a flask and heated to a temperature of 200° C. over 1 hour. After confirmation that the reaction system has been uniformly stirred, 1.2 parts of dibutyl tin oxide is added. While water produced is removed by evaporation, the temperature is increased to 240° C. over 6 hours, and the stirring is continued at 240° C. for 4 hours to thereby obtain a polyester resin (acid value: 9.4 mgKOH/g, weight average molecular weight: 13000, glass transition temperature: 62° C.). This polyester resin in a molten state is transferred to an emulsifying-dispersing apparatus (CAVITRON CD1010, EUROTEC Co., Ltd.) at a rate of 100 g/minute. Separately, diluted ammonia water prepared by diluting reagent ammonia water with ion exchanged water to a concentration of 0.37% is placed in a tank. While heated to 120° C. using a heat exchanger, the diluted ammonia water, together with the polyester resin, is transferred to the emulsifying-dispersing apparatus at a rate of 0.1 L/minute. The emulsifying-dispersing apparatus is operated under the following conditions: rotor rotation speed: 60 Hz; and pressure: 5 kg/cm$^2$. A resin particle dispersion (1) with a volume average particle diameter of 160 nm and a solid content of 30% is thereby obtained. [Preparation of resin particle dispersion (2)]

| | |
|---|---|
| Decanedioic acid (TOKYO CHEMICAL INDUSTRY Co., Ltd.) | 81 parts |
| Hexanediol (FUJIFILM Wako Pure Chemical Corporation) | 47 parts |

The above materials are placed in a flask and heated to a temperature of 160° C. over 1 hour. After confirmation that the reaction system has been uniformly stirred, 0.03 parts of dibutyl tin oxide is added. While water produced is removed by evaporation, the temperature is increased to 200° C. over 6 hours, and the stirring is continued at 200° C. for 4 hours. Then the reaction solution is cooled and subjected to solid-liquid separation. The solid is dried at a temperature of 40° C. under reduced pressure to thereby obtain a polyester resin (C1) (melting point: 64° C., weight average molecular weight: 15000).

| | |
|---|---|
| Polyester resin (C1) | 50 parts |
| Anionic surfactant (Neogen SC, DAI-ICHI KOGYO SEIYAKU Co., Ltd.) | 2 parts |
| Ion exchanged water | 200 parts |

The above materials are heated to 120° C., sufficiently dispersed using a homogenizer (ULTRA-TURRAX T50, IKA), and then subjected to dispersion treatment using a pressure discharge-type homogenizer. When the volume average particle diameter reaches 180 nm, the product is collected, and a resin particle dispersion (2) with a solid content of 20%) is thereby obtained.

[Preparation of Coloring Agent Particle Dispersion (1)]

| | |
|---|---|
| Cyan pigment (Pigment Blue 15:3, Dainichiseika Color & Chemicals Mfg. Co., Ltd.) | 10 parts |
| Anionic surfactant (Neogen SC, DAI-ICHI KOGYO SEIYAKU Co., Ltd.) | 2 parts |
| Ion exchanged water | 80 parts |

The above materials are mixed and dispersed for 1 hour using a high-pressure impact disperser (Ultimaizer HJP30006, Sugino Machine Limited) to thereby obtain a coloring agent particle dispersion (1) with a volume average particle diameter of 180 nm and a solid content of 20%.

[Preparation of Release Agent Particle Dispersion (1)]

| | |
|---|---|
| Paraffin wax (HNP-9, Nippon Seiro Co., Ltd.) | 50 parts |
| Anionic surfactant (Neogen SC, DAI-ICHI KOGYO SEIYAKU Co., Ltd.) | 2 parts |
| Ion exchanged water | 200 parts |

The above materials are heated to 120° C., sufficiently dispersed using a homogenizer (ULTRA-TURRAX T50, IKA), and then subjected to dispersion treatment using a pressure discharge-type homogenizer. When the volume average particle diameter reaches 200 nm, the product is collected, and a release agent particle dispersion (1) with a solid content of 20% is thereby obtained.

[Production of Toner (1)]

| | |
|---|---|
| Resin particle dispersion (1) | 150 parts |
| Resin particle dispersion (2) | 50 parts |
| Coloring agent particle dispersion (1) | 25 parts |
| Release agent particle dispersion (1) | 35 parts |
| Aluminum polychloride | 0.4 parts |
| Ion exchanged water | 100 parts |

The above materials are placed in a stainless steel-made round flask, mixed and dispersed sufficiently using a homogenizer (ULTRA-TURRAXT50, IKA), and then heated to 48° C. in an oil bath for heating while the mixture in the flask is stirred. The reaction system is held at 48° C. for 60 minutes, and then an additional 70 parts of the resin particle dispersion (1) is gently added. Next, a 0.5 mol/L aqueous sodium hydroxide solution is used to adjust the pH to 8.0. The flask is hermetically sealed, and a stirring shaft is magnetically sealed. While the stirring is continued, the reaction system is heated to 90° C. and held for 30 minutes. Next, the reaction system is cooled at a cooling rate of 5° C./minute, subjected to solid-liquid separation, and washed sufficiently with ion exchanged water. Then the mixture is subjected to solid-liquid separation, re-dispersed in ion exchanged water at 30° C., and washed by stirring at a rotation speed of 300 rpm for 15 minutes. This washing procedure is repeated 6 times. When the pH of the filtrate reaches 7.54 and its electric conductivity reaches 6.5 μS/cm, the mixture is subjected to solid-liquid separation, and vacuum drying is performed for 24 hours to thereby obtain toner particles (1) with a volume average particle diameter of 5.7 μm.

100 Parts of the toner particles (1) and 0.7 parts of hydrophobic silica (RY50 manufactured by Nippon Aerosil Co., Ltd.) are mixed using a Henschel mixer to obtain a toner (1)

Production of Carrier

[Preparation of Core Material]

—Ferrite Particles (1)—

74 Pars of $Fe_2O_3$, 4 parts of $Mg(OH)_2$, and 21 parts of $MnO_2$ are mixed, and then the mixture is calcinated using a rotary kiln under the conditions of temperature: 950° C./7 hours (first calcination). The calcinated product is pulverized for 7 hours using a wet ball mill to adjust the average particle diameter to 2.0 μm, and the pulverized product is granulated using a spray dryer. The granulated product is calcinated using a rotary kiln under the conditions of temperature: 950° C./6 hours (second calcination). The calcinated product is pulverized for 3 hours using a wet ball mill to adjust the average particle diameter to 5.6 μm, and the pulverized product is granulated using a spray dryer. The granulated product is fired using an electric furnace under the conditions of temperature: 1300° C./5 hours. The fired product obtained is pulverized and classified to thereby obtain ferrite particles (1) having a volume average diameter of 32 μm.

—Ferrite Particles (2)—

Ferrite particles (2) are obtained in the same manner as in the production of the ferrite particles (1) except that the calcinated product obtained by the second calcination is pulverized for 2 hours using a wet ball mill to adjust the average particle diameter to 6.5 μm and that the firing conditions are changed to temperature: 1200° C./4 hours.

—Ferrite Particles (3)—

Ferrite particles (3) are obtained in the same manner as in the production of the ferrite particles (1) except that the calcinated product obtained by the second calcination is pulverized for 5 hours using a wet ball mill to adjust the average particle diameter to 4.7 μm and that the firing conditions are changed to temperature: 1350° C./5.5 hours.

The types of core materials, their volume average diameters, and their surface roughness are shown in Table 1. The volume average diameter and the surface roughness Ra (μm) of each core material are determined by the measurement methods described above.

TABLE 1

| Type of core material | Volume average particle diameter [μm] | Surface roughness of core material Ra [μm] | Average length of roughness curve elements of core material RSm [μm] |
|---|---|---|---|
| Ferrite particles (1) | 32 | 0.9 | 1.4 |
| Ferrite particles (2) | 32 | 0.9 | 3.5 |
| Ferrite particles (3) | 32 | 0.9 | 0.8 |

[Preparation of Inorganic Particles]

The following materials are used as silica particles, titania particles, and alumina particles.

Silica Particles
Hydrophobic treatment agent: hexamethyldisilazane
Volume average diameter D: 12 nm
Product No. HM20S manufactured by Tokuyama Corporation Silica Particles
Hydrophobic treatment agent: decylsilane
Volume average diameter D: 40 nm
Product No. OX50 manufactured by Nippon Aerosil Co., Ltd. is treated with decylsilane to produce silica particles.

Silica Particles
Hydrophobic treatment agent: none
Volume average diameter D: 40 nm
Product No. OX50 manufactured by Nippon Aerosil Co., Ltd.

Silica Particles
Hydrophobic treatment agent: polydimethylsiloxane
Volume average diameter D: 40 nm
Product No. RY50 manufactured by Nippon Aerosil Co., Ltd.

Silica Particles
Hydrophobic treatment agent: hexamethyldisilazane
Volume average diameter D: 200 nm
Product No. TG-6020N manufactured by CABOT Silica Particles (Synthesized Product 1 Synthesized by the Following Synthesis Method)

Hydrophobic treatment agent: hexamethyldisilazane

Volume average diameter D: 7 nm (Preparation of Silica Particle Dispersion (1))

890 Parts of methanol and 210 parts of 9.81 ammonia water are added to a 1.5 L glass-made reaction vessel equipped with a stirrer, a dropping nozzle, and a thermometer and mixed to thereby obtain an alkaline catalyst solution.

The temperature of the alkaline catalyst solution is adjusted to 45° C., and then 550 parts of tetramethoxysilane and 140 parts of 7.6% ammonia water are simultaneously added dropwise over 450 minutes under stirring to thereby obtain a hydrophilic silica particle dispersion (1) having a particle diameter of 7 nm and a particle size distribution index of 1.2.

(Production of Surface-Treated Silica Particles (S1))

The silica particles in the silica particle dispersion (1) are subjected to surface treatment with a siloxane compound in a supercritical carbon dioxide atmosphere as follows. A device equipped with a carbon dioxide cylinder, a carbon dioxide pump, an entrainer pump, an autoclave (capacity: 500 mL) equipped with a stirrer, and a pressure valve is used for the surface treatment.

First, the autoclave (capacity: 500 mL) equipped with the stirrer is charged with 300 parts of the silica particle dispersion (1), and the stirrer is rotated at 100 rpm. Then liquified carbon dioxide is injected into the autoclave. The pressure is increased using the carbon dioxide pump while the temperature is increased using a heater, and a supercritical state at 150° and 15 MPa is formed in the autoclave. While the pressure valve is used to maintain the pressure inside the autoclave at 15 MPa, the supercritical carbon dioxide is circulated using the carbon dioxide pump to remove methanol and water from the silica particle dispersion (1) (a solvent removing step), and silica particles (untreated silica particles) are thereby obtained.

When the circulation amount of the supercritical carbon dioxide (the cumulative amount: measured as the circulation amount of carbon dioxide in the standard conditions) reaches 900 parts, the circulation of the supercritical carbon dioxide is stopped.

Then the heater is used to maintain the temperature at 150° C., and the carbon dioxide pump is used to maintain the pressure at 15 MPa to maintain the supercritical state of carbon dioxide in the autoclave. In this state, 50 parts of hexamethyldisilazane (HMDS manufactured by YUKI GOSEI KOGYO CO., LTD.) used as the hydrophobic treatment agent based on 100 parts of the silica particles (untreated silica particles) is injected into the autoclave using the entrainer pump. Then the mixture is allowed to react at 180° C. for 20 minutes under stirring. Then supercritical carbon dioxide is again circulated to remove the excess treatment solution. Then the stirring is stopped, and the pressure valve is opened to reduce the pressure inside the autoclave to the atmospheric pressure and reduce the temperature to room temperature (25° C.). As described above, the solvent removing step and the surface treatment with the siloxane compound are performed successively to thereby obtain surface-treated silica particles (S1) having a volume-based particle diameter of 7 nm.

Silica Particles (Synthesized Product 2 Synthesized by the Following Synthesis Method)

Hydrophobic treatment agent: hexamethyldisilazane

Volume average diameter D: 1 nm (Preparation of Silica Particle Dispersion (2))

890 Parts of methanol and 210 parts of 9.8% ammonia water are added to a 1.5 L glass-made reaction vessel equipped with a stirrer, a dropping nozzle, and a thermometer and mixed to thereby obtain an alkaline catalyst solution.

The temperature of the alkaline catalyst solution is adjusted to 47° C., and 550 parts of tetramethoxysilane and 140 parts of 7.6% ammonia water are simultaneously added dropwise over 450 minutes under stirring to thereby obtain a hydrophilic silica particle dispersion (2) having a particle diameter of 1 nm and a particle size distribution index of 1.25.

(Production of Surface-Treated Silica Particles (S2))

The silica particles in the silica particle dispersion (2) are subjected to surface treatment with a siloxane compound in a supercritical carbon dioxide atmosphere as follows. A device equipped with a carbon dioxide cylinder, a carbon dioxide pump, an entrainer pump, an autoclave (capacity: 500 mL) equipped with a stirrer, and a pressure valve is used for the surface treatment.

First, the autoclave (capacity: 500 mL) equipped with the stirrer is charged with 300 parts of the silica particle dispersion (2), and the stirrer is rotated at 100 rpm. Then liquified carbon dioxide is injected into the autoclave. The pressure is increased using the carbon dioxide pump while the temperature is increased using a heater, and a supercritical state at 150° C. and 15 MPa is formed in the autoclave. While the pressure valve is used to maintain the pressure inside the autoclave at 15 MPa, the supercritical carbon dioxide is circulated using the carbon dioxide pump to remove methanol and water from the silica particle dispersion (2) (a solvent removing step), and silica particles (untreated silica particles) are thereby obtained.

When the circulation amount of the supercritical carbon dioxide (the cumulative amount: measured as the circulation amount of carbon dioxide in the standard conditions) reaches 900 parts, the circulation of the supercritical carbon dioxide is stopped.

Then the heater is used to maintain the temperature at 150° C., and the carbon dioxide pump is used to maintain the pressure at 15 MPa to maintain the supercritical state of carbon dioxide in the autoclave. In this state, 100 parts of hexamethyldisilazane (HMDS manufactured by YUKI GOSEI KOGYO CO., LTD.) used as the hydrophobic treatment agent based on 100 parts of the silica particles (untreated silica particles) is injected into the autoclave using the entrainer pump. Then the mixture is allowed to react at 180° C. for 20 minutes under stirring. Then supercritical carbon dioxide is again circulated to remove the excess treatment solution. Then the stirring is stopped, and the pressure valve is opened to reduce the pressure inside the autoclave to the atmospheric pressure and reduce the temperature to room temperature (25° C.). As described above, the solvent removing step and the surface treatment with the siloxane compound are performed successively to thereby obtain surface-treated silica particles (S2) having a volume-based particle diameter of 1 nm.

Titania Particles

Hydrophobic treatment agent: isobutylsilane

Volume average diameter D: 20 nm

Product No. STT100H manufactured by Titan Kogyo, Ltd.

Alumina Particles

Hydrophobic treatment agent: decylsilane

Volume average diameter D: 13 nm

Product number C805 manufactured by Nippon Aerosil Co., Ltd.

Example 1

| | |
|---|---|
| Ferrite particles (1) | 100 parts |
| Silica particles (HM20S manufactured by Tokuyama Corporation) | 0.7 parts |
| Cyclohexyl methacrylate/methyl methacrylate copolymer (copolymerization ratio: 95 moles:5 moles) | 3 parts |
| Toluene | 14 parts |

Among the above materials, the silica particles, the cyclohexyl methacrylate/methyl methacrylate copolymer, and toluene, together with glass beads (diameter: 1 mm, the same amount as toluene), are placed in a sand mill (Kansai Paint Co., Ltd.) and stirred at a rotation speed of 1200 rpm for 30 minutes to obtain a resin layer-forming solution (1). The ferrite particles (1) are placed in a vacuum degassed-type kneader, and then the resin layer-forming solution (1) is placed in the kneader. While the pressure inside the kneader is reduced, the temperature thereinside is increased under stirring to remove toluene by evaporation, and the ferrite resin (1) is thereby coated with the resin. Then fine powders and coarse powders are removed using an Elbow-Jet to thereby obtain a carrier (1). The properties of the carrier (1) are shown in Table 2.

Examples 2 to 25 and Comparative Examples 1 to 6

Carriers in Examples and Comparative Examples are produced in the same manner as in the production of the carrier (1) except that the types and amounts of core material, inorganic particles, and resin, the thickness of the coating resin layer, D/T, D/Ra, the liberation ratio, and the surface roughness of each carrier are changed as shown in Table 2. Abbreviations in the table are as follows.

CHMA: cyclohexyl methacrylate
MMA: methacrylate
DMAEMA: 2-(dimethylamino)ethyl methacrylate
HMDS: hexamethyldisilazane
PDMS: polydimethylsiloxane (silicone oil)

TABLE 2

| | Core material | Coating resin layer | | | | | | | | | | | | |
|---|---|---|---|---|---|---|---|---|---|---|---|---|---|---|
| | | Inorganic particles | | | | | Resin | | Thickness T | | | | | |
| | Type | Type | Hydrophobic treatment agent | Volume average particle diameter D [nm] | [Parts] | Content based on total mass of coating resin layer [% by mass] | Type/[mixing ratio] | [Parts] | [μm] | D/T | D/Ra | Liberation | Surface | Evaluation: Initial | Evaluation: Temporal |
| Example 1 | (1) | Silica particles | HMDS | 12 | 0.90 | 30 | CHMA/MMA = 95/5 | 2.1 | 1.00 | | | | | | |
| Comparative Example 1 | (1) | Silica particles | HMDS | 12 | 0.02 | 4 | CHMA/MMA = 95/5 | 0.5 | 0.04 | | | | | | |
| Comparative Example 2 | (1) | Silica particles | HMDS | 11 | 0.50 | 11 | CHMA/MMA = 95/5 | 3.9 | 1.80 | | | | | | |
| Comparative Example 3 | (1) | Silica particles | HMDS | 12 | 1.90 | 63 | CHMA/MMA = 95/5 | 1.1 | 0.30 | | | | | | |
| Comparative Example 4 | (1) | Silica particles | HMDS | 12 | 0.20 | 7 | CHMA/MMA = 95/5 | 2.8 | 1.10 | | | | | | |
| Comparative Example 5 | (1) | — | — | — | 0.00 | 0 | CHMA/MMA = 95/5 | 3.0 | 1.20 | | | | | | |
| Comparative Example 6 | (1) | Silica particles | HMDS | 200 | 0.70 | 33 | CHMA/MMA = 95/5 | 1.4 | 0.80 | | | | | | |
| Example 2 | (1) | Silica particles | HMDS | 12 | 0.30 | 13 | CHMA/MMA = 95/5 | 2.1 | 1.00 | | | | | | |
| Example 3 | (1) | Silica particles | HMDS | 12 | 0.60 | 22 | CHMA/MMA = 95/5 | 2.1 | 1.00 | | | | | | |
| Example 4 | (1) | Silica particles | HMDS | 7 | 0.90 | 30 | CHMA/MMA = 95/5 | 2.1 | 1.00 | | | | | | |
| Example 5 | (1) | Silica particles | HMDS | 90 | 0.90 | 30 | CHMA/MMA = 95/5 | 2.1 | 1.00 | | | | | | |
| Example 6 | (1) | Silica particles | HMDS | 1 | 0.90 | 30 | CHMA/MMA = 95/5 | 2.1 | 1.00 | | | | | | |
| Example 7 | (2) | Silica particles | HMDS | 12 | 0.90 | 30 | CHMA/MMA = 95/5 | 2.1 | 1.00 | | | | | | |
| Example 8 | (3) | Silica particles | HMDS | 12 | 0.90 | 30 | CHMA/MMA = 95/5 | 2.1 | 1.00 | | | | | | |
| Example 9 | (1) | Silica particles | HMDS | 12 | 1.80 | 60 | CHMA/MMA = 95/5 | 1.2 | 0.30 | | | | | | |
| Example 10 | (1) | Silica particles | HMDS | 12 | 1.50 | 30 | CHMA/MMA = 95/5 | 3.5 | 1.60 | | | | | | |
| Example 11 | (1) | Titania particles | Isobutylsilane | 20 | 0.90 | 30 | CHMA/MMA = 95/5 | 2.1 | 1.00 | | | | | | |
| Example 12 | (1) | Alumina particles | Decylsilane | 13 | 0.90 | 30 | CHMA/MMA = 95/5 | 2.1 | 1.00 | | | | | | |
| Example 13 | (1) | Silica particles | Decylsilane | 40 | 0.90 | 30 | CHMA/MMA = 95/5 | 2.1 | 1.00 | | | | | | |
| Example 14 | (1) | Silica particles | PDMS | 40 | 0.90 | 30 | CHMA/MMA = 95/5 | 2.1 | 1.00 | | | | | | |
| Example 15 | (1) | Silica particles | — | 40 | 0.90 | 30 | CHMA/MMA = 95/5 | 2.1 | 1.00 | | | | | | |
| Example 16 | (1) | Silica particles | HMDS | 12 | 0.90 | 30 | MMA = 100 | 2.1 | 1.00 | | | | | | |
| Example 17 | (1) | Silica particles | HMDS | 12 | 0.90 | 30 | CHMA = 100 | 2.1 | 1.00 | | | | | | |
| Example 18 | (1) | Silica particles | HMDS | 12 | 0.90 | 30 | DMAEMA = 100 | 2.1 | 1.00 | | | | | | |
| Example 19 | (1) | Silica particles | HMDS | 12 | 0.90 | 30 | CHMA/MMA = 75/25 | 2.1 | 1.00 | | | | | | |
| Example 20 | (1) | Silica particles | HMDS | 12 | 0.90 | 30 | CHMA/DMAEMA = 95/5 | 2.1 | 1.00 | | | | | | |
| Example 21 | (1) | Silica particles | HMDS | 12 | 0.90 | 30 | St = 100 | 2.1 | 1.00 | | | | | | |
| Example 22 | (1) | Silica particles | HMDS | 200 | 0.90 | 30 | CHMA/MMA = 95/5 | 2.1 | 1.00 | | | | | | |
| Example 23 | (1) | Silica particles | HMDS | 1 | 0.90 | 64 | CHMA/MMA = 95/5 | 0.5 | 0.05 | | | | | | |
| Example 24 | (1) | Silica particles | HMDS | 12 | 0.50 | 50 | CHMA/MMA = 95/5 | 0.5 | 0.04 | | | | | | |
| Example 25 | (1) | Silica particles | HMDS | 12 | 0.60 | 13 | CHMA/MMA = 95/5 | 4.0 | 1.70 | | | | | | |

TABLE 2-continued

| | ([μm]/[μm]) | ([μm]/[μm]) | ratio [%] | roughness Ra [μm] | Fogging | density unevenness | density unevenness |
|---|---|---|---|---|---|---|---|
| Example 1 | 0.012 | 0.030 | 80 | 0.4 | A | A | A |
| Comparative Example 1 | 0.300 | 0.030 | 35 | 0.4 | B | A | D |
| Comparative Example 2 | 0.006 | 0.037 | 45 | 0.3 | C | B | D |
| Comparative Example 3 | 0.040 | 0.024 | 45 | 0.5 | D | C | D |
| Comparative Example 4 | 0.011 | 0.040 | 40 | 0.3 | B | D | C |
| Comparative Example 5 | — | — | 30 | 0.1 | B | D | D |
| Comparative Example 6 | 0.250 | 0.400 | 45 | 0.5 | D | A | D |
| Example 2 | 0.012 | 0.030 | 55 | 0.4 | C | A | C |
| Example 3 | 0.012 | 0.030 | 60 | 0.4 | C | A | B |
| Example 4 | 0.007 | 0.129 | 85 | 0.4 | A | A | A |
| Example 5 | 0.090 | 0.180 | 65 | 0.5 | B | A | C |
| Example 6 | 0.001 | 0.003 | 85 | 0.4 | A | C | A |
| Example 7 | 0.012 | 0.013 | 80 | 0.9 | A | B | B |
| Example 8 | 0.012 | 0.120 | 80 | 0.1 | A | B | B |
| Example 9 | 0.040 | 0.013 | 80 | 0.9 | A | C | B |
| Example 10 | 0.008 | 0.120 | 80 | 0.1 | A | A | A |
| Example 11 | 0.020 | 0.050 | 80 | 0.4 | B | A | A |
| Example 12 | 0.013 | 0.033 | 80 | 0.4 | B | A | A |
| Example 13 | 0.040 | 0.100 | 75 | 0.4 | A | A | B |
| Example 14 | 0.040 | 0.100 | 75 | 0.4 | A | A | B |
| Example 15 | 0.040 | 0.100 | 75 | 0.4 | A | A | B |
| Example 16 | 0.012 | 0.030 | 80 | 0.4 | B | A | A |
| Example 17 | 0.012 | 0.030 | 80 | 0.4 | A | A | A |
| Example 18 | 0.012 | 0.030 | 80 | 0.4 | A | B | B |
| Example 19 | 0.012 | 0.030 | 80 | 0.4 | A | A | A |
| Example 20 | 0.012 | 0.030 | 80 | 0.4 | A | A | A |
| Example 21 | 0.012 | 0.030 | 80 | 0.4 | B | A | A |
| Example 22 | 0.200 | 0.500 | 70 | 0.4 | A | C | C |
| Example 23 | 0.020 | 0.003 | 85 | 0.4 | A | B | A |
| Example 24 | 0.300 | 0.030 | 75 | 0.4 | B | A | B |
| Example 25 | 0.007 | 0.030 | 80 | 0.4 | A | A | B |

Initial Density Unevenness and Evaluation of Fogging

The following test is performed. A printer obtained by modifying DocuCentre Color 400 (manufactured by Fuji Xerox Co., Ltd.) is used, and plain A4 paper sheets (C2 paper manufactured by Fuji Xerox Co., Ltd.) are used. An image including a rectangular patch is printed continuously on 500 sheets in an environment of 22.5° C./50% RH such that the image density is 1%. Then the environment is changed to 28° C./90% RH. In the early morning on the following day, a test chart No. 5-1 of the Imaging Society of Japan is outputted, and the quality of the image is evaluated.

—Evaluation of Fogging—

After the continuous printing, the environment is changed to 28° C./90% RH. In the early morning on the following day, the test chart No. 5-1 of the Imaging Society of Japan is outputted on 5 sheets, and non-image portions in the 5 sheets and the degree of contamination in the device after printing are visually inspected and sensorily evaluated. A to C ratings are permissible.

A: No contamination is observed in the non-image portions in the images, and no image quality problem is found.

B: Toner scattering occurs in the device, but no image quality problem is found.

C: Slight contamination is observed in the non-image portions in the images.

D: Contamination is clearly observed in the non-image portions in the images.

—Density Unevenness Evaluation—

The test chart No. 5-1 of the Imaging Society of Japan is outputted on 5 sheets, and the densities of solid patch portions are measured. ΔE is computed in the following manner. A to C ratings are permissible.

$$\Delta E = (\text{the maximum image density in the 5 sheets}) - (\text{the minimum image density in the 5 sheets})$$

The image density ($=(L^{*2}+a^{*2}+b^{*2})^{0.5}$) is measured using an image density meter X-RITE 938 (manufactured by X-RITE).

A: The density unevenness ΔE in the images is less than 0.3 and cannot be observed visually, and no image quality problem is found.

B: The density unevenness ΔE in the images is 0.3 or more and 0.5 or less. Although slight unevenness is found, the level of the unevenness causes no image quality problem.

C: The density unevenness ΔE in the images is 0.5 or more and 1.0 or less, and slight unevenness is observed.

D: The density unevenness ΔE in the images exceeds 1.0, and density unevenness is clearly observed in the images.

Evaluation of temporal density unevenness

The following test is performed. A printer obtained by modifying DocuCentre Color 400 (manufactured by Fuji Xerox Co., Ltd.) is used, and plain A4 paper sheets (C2 paper manufactured by Fuji Xerox Co., Ltd.) are used. An image including a rectangular patch is printed on 100,000 sheets over 10 days in an environment of 22.5° C./50% RH such that the image density is 1%. After 100,000 sheets have been outputted, the environment is changed to 28° C./90% RH. In the early morning on the following day, the test chart No. 5-1 of the Imaging Society of Japan is outputted, and the quality of the image is evaluated.

As shown in Table 2, in the carrier for electrostatic image development in each Example, the density unevenness in images is smaller than that in the carrier for electrostatic image development in each Comparative Example.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A carrier for electrostatic image development, comprising:

a core material; and a coating resin layer that contains inorganic particles and covers the core material, wherein a content of the inorganic particles is 10% by mass or more and 60% by mass or less based on a total mass of the coating resin layer, and wherein a volume average diameter D (μm) of the inorganic particles and a thickness T (μm) of the coating resin layer satisfy the following relational expression (1):

$$0.007 \leq D/T \leq 0.24.$$

2. The carrier for electrostatic image development according to claim 1, wherein the volume average diameter D of the inorganic particles is more than 1 nm and 80 nm or less.

3. The carrier for electrostatic image development according to claim 1, wherein the surface roughness Ra of the carrier is more than 0.1 μm and less than 0.9 μm.

4. The carrier for electrostatic image development according to claim 1, wherein the inorganic particles include silica particles.

5. The carrier for electrostatic image development according to claim 4, wherein the silica particles include silica particles subjected to hydrophobic treatment.

6. The carrier for electrostatic image development according to claim 5, wherein a treatment agent for the hydrophobic treatment is at least one of hexamethyldisilazane (HMDS) and dimethylpolysiloxane (PDMS).

7. The carrier for electrostatic image development according to claim 1, wherein the coating resin layer contains an alicyclic (meth)acrylic resin.

8. The carrier for electrostatic image development according to claim 7, wherein the alicyclic (meth)acrylic resin contains cyclohexyl (meth)acrylate as a monomer component.

9. The carrier for electrostatic image development according to claim 1, wherein the volume average diameter D (μm) of the inorganic particles and a surface roughness Ra (μm) of the carrier satisfy the following relational expression (2):

$$0.003 < D/Ra < 0.50.$$

10. The carrier for electrostatic image development according to claim 1, wherein the surface roughness Ra of the core material is 0.5 μm or more and 1.5 μm or less.

11. An electrostatic image developer comprising:

a toner for electrostatic image development: and the carrier for electrostatic image development according to claim 1.

12. A process cartridge detachably attached to an image forming apparatus, the process cartridge comprising:

an image holding member; and a developing device that contains the electrostatic image developer according to claim 11 and develops, as a toner image, an electrostatic image formed on a surface of the image holding member using the electrostatic image developer.

* * * * *